US010066621B2

(12) United States Patent
Izutsu et al.

(10) Patent No.: US 10,066,621 B2
(45) Date of Patent: Sep. 4, 2018

(54) INTERNAL GEAR PUMP INCLUDING AN OUTER RING HAVING CAM PROTRUDED PARTS

(71) Applicant: YAMADA MANUFACTURING CO., LTD, Kiryu-shi (JP)

(72) Inventors: Masato Izutsu, Isesaki (JP); Takatoshi Watanabe, Isesaki (JP); Junichi Miyajima, Isesaki (JP); Yasuhiro Kosugi, Isesaki (JP); Kosuke Yamane, Isesaki (JP)

(73) Assignee: YAMADA MANUFACTURING CO., LTD., Kiryu-Shi, Gunma (JP)

( * ) Notice: Subject to any disclaimer, the term of this patent is extended or adjusted under 35 U.S.C. 154(b) by 1133 days.

(21) Appl. No.: 14/088,229

(22) Filed: Nov. 22, 2013

(65) Prior Publication Data

US 2014/0154120 A1 Jun. 5, 2014

(30) Foreign Application Priority Data

Nov. 30, 2012 (JP) ..... 2012-262992
Feb. 19, 2013 (JP) ..... 2013-30454

(51) Int. Cl.
*F04C 14/22* (2006.01)
*F04C 2/10* (2006.01)
*F04C 14/10* (2006.01)

(52) U.S. Cl.
CPC ..... *F04C 14/223* (2013.01); *F04C 2/10* (2013.01); *F04C 14/10* (2013.01); *F04C 14/226* (2013.01)

(58) Field of Classification Search
CPC ..... F04C 14/10; F04C 14/226; F04C 18/10; F04C 28/22; F04C 2/10
USPC ..... 418/19, 150
See application file for complete search history.

(56) References Cited

U.S. PATENT DOCUMENTS

| | | | | |
|---|---|---|---|---|
| 4,813,856 | A | 3/1989 | Dlugokecki | |
| 9,399,994 | B2 * | 7/2016 | Izutsu | F04C 2/10 |
| 2011/0197846 | A1 * | 8/2011 | Shinomiya | F01M 1/20 123/196 R |

FOREIGN PATENT DOCUMENTS

| | | | |
|---|---|---|---|
| JP | 2008-215326 | A | 9/2008 |
| JP | 2012-132356 | A | 7/2012 |
| WO | WO 2005/019650 | A1 | 3/2005 |

(Continued)

OTHER PUBLICATIONS

Japanese Office Action dated Mar. 20, 2015.

(Continued)

*Primary Examiner* — Mark Laurenzi
(74) *Attorney, Agent, or Firm* — McGinn I.P. Law Group, PLLC.

(57) ABSTRACT

The internal gear pump according to the present invention includes: an inner rotor; an outer rotor that rotates with predetermined eccentricity to a rotation center of the inner rotor; an outer ring that rotatably holds the outer rotor, and has at least three cam protruded parts formed; a pump housing that has a rotor chamber; pins in the same number as that of the cam protruded parts; and operation means for oscillating the outer ring. Positions of the pins are set so that a diameter center of the holding-inner peripheral part of the outer ring is moved by the operation means along a locus of a circle, the radius of which is the eccentricity to the rotation center of the inner rotor.

32 Claims, 9 Drawing Sheets

(56) References Cited

FOREIGN PATENT DOCUMENTS

WO WO 2010/013625 A1 2/2010

OTHER PUBLICATIONS

United States Office Action dated May 26, 2015 in co-pending U.S. Appl. No. 14/088,220.
English Machine translation of WO 2005/019650 A1 (translated on Apr. 20, 2015).
U.S. Office Action dated Nov. 25, 2015 in U.S. co-pending U.S. Appl. No. 14/088,220.

* cited by examiner

ENLARGED (α) PART

ENLARGED (γ) PART

ENLARGED (β) PART

VIEWD FROM ARROWHEAD LINE Y1-Y1

Fig.2A
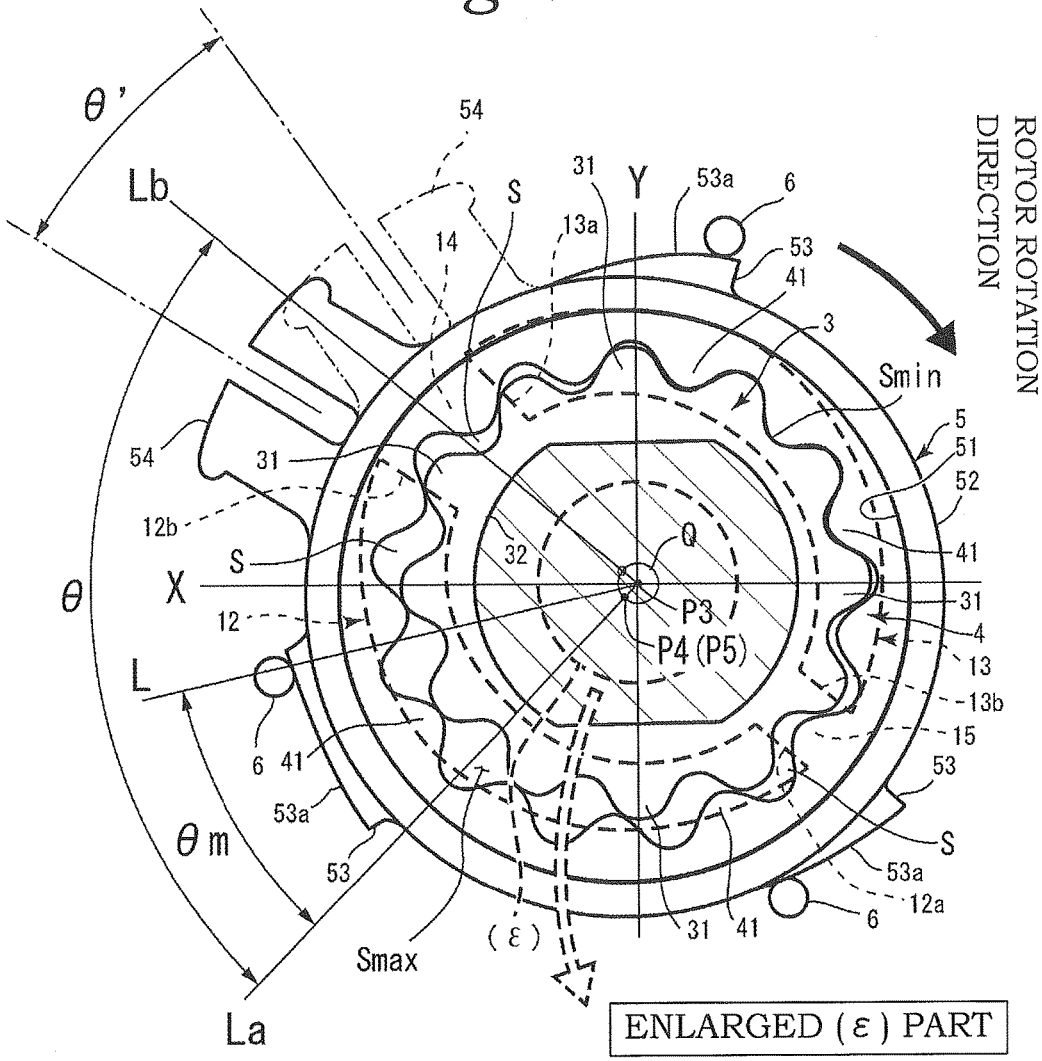
$\theta' = k\,\theta m$
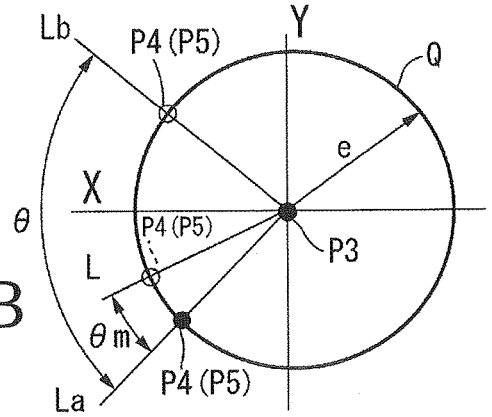
Fig.2B $$x' = (x + e*\cos\theta m)*\cos(\theta m*k) - (y - e*\cos\theta m)*\sin(\theta m*k)$$

$$y' = (x + e*\cos\theta m)*\cos(\theta m*k) + (y - e*\cos\theta m)*\cos(\theta m*k) + e$$

$$\theta' = k\,\theta m$$

(λ)

VIEWED FROM ARROWHEAD LINE Y3 - Y3

INTERNAL GEAR PUMP INCLUDING AN OUTER RING HAVING CAM PROTRUDED PARTS

BACKGROUND OF THE INVENTION

1. Field of the Invention

The present invention relates to an internal gear pump capable of varying a discharge quantity of a fluid by causing an inner rotor to change a position of an outer rotor to which the inner rotor is brought into contact, with this internal gear pump capable of being easily manufactured and also capable of maintaining high product precision.

2. Description of the Related Art

Conventionally, there have been internal gear pumps that include an inner rotor and an outer rotor with which the inner rotor is brought into contact. As this kind of an internal gear pump, there exists a variable-capacity type internal gear pump that has an outer rotor having a rotation center at a position eccentric to a rotation center of an inner rotor which has a fixed position. The rotation center of the outer rotor moves along a locus of a circle of which a radius is the eccentricity to the rotation center of the inner rotor.

The variable-capacity type internal gear pump has a base line connecting between the rotation center of the inner rotor and the rotation center of the outer rotor. The base line rotates around the rotation center of the inner rotor.

There are various kinds of internal gear pumps that include such means for moving the outer rotor along a predetermined locus. The oil pump described in Japanese Patent Application Laid-open No. 2012-132356 is outlined below as an example. In the following description, reference numbers attached to members are those used in Japanese Patent Application Laid-open No. 2012-132356.

The oil pump described in Japanese Patent Application Laid-open No. 2012-132356 includes the adjusting ring 14 for moving the outer rotor 13 in a predetermined locus. At the casing 1 side of the oil pump, there are provided concave shape portions such as a guide groove, and convex shape portions including guide pins and protruded parts. The adjusting ring 14 moves along the concave shape portions and the convex shape portions via a moving means.

SUMMARY OF THE INVENTION

The oil pump described in Japanese Patent Application Laid-open No. 2012-132356 has the following problems or disadvantages. In general, the casing 1 of the oil pump is manufactured by casting an aluminum alloy. As described above, the concave shape and the convex shape in the casing 1 are required to have particularly high dimensional precision. That is, the concave shape and the convex shape require dimensional precision approximately equivalent to that of a teeth form of a rotor of the oil pump. Specifically, dimensional precision of about ±20 μm to ±30 μm is necessary.

However, it is difficult to obtain dimensional precision of ±20 μm to ±30 μm by only casting the aluminum alloy (without cutting work). Therefore, concave shape parts and convex shape parts at the side of the casing 1 manufactured by casting the aluminum alloy are required to generate higher dimensional precision by performing the cutting work. As a result, the oil pump becomes very expensive, and also has a long manufacturing time.

A small volume of contaminants (foreign matters) are present in the oil. When the contaminants (foreign matters) are adhered to the concave shape portions such as the guide groove of the casing 1, the contaminants cannot be discharged because of the shape of concavity. Therefore, the contaminants continue to be pooled in the concave shape portion such as the guide groove. In such a situation, when the convex shape portion of the adjusting ring 14 slides into the concave shape portion of the casing 1, the convex shape portion is hung up at a portion where the contaminants of the concave shape portion are pooled. This has a risk of interrupting smooth movement of the adjusting ring.

An object of the present invention is to provide a variable-capacity type internal gear pump that includes an inner rotor and an outer rotor which is brought into contact with the inner rotor, and that has an extremely simple structure and also has high precision as a manufactured product.

As a result of intensive studies carried out to solve the above problem, as a first aspect of the present invention, the present inventor has provided an internal gear pump including: an inner rotor; an outer rotor that rotates with predetermined eccentricity to a rotation center of the inner rotor; an outer ring that includes a holding-inner peripheral part rotatably holding the outer rotor and that has at least three cam protruded parts formed along a circumferential direction of an outer periphery surface of the outer ring; a pump housing that has a rotor chamber in which the outer ring is freely and oscillatably arranged; pins that are in the same number as that of the cam protruded parts and are always brought into contact with the cam protruded parts, and that are installed in the rotor chamber as members separate from the pump housing; and operation means for oscillating the outer ring. Positions of the pins are set so that a diameter center of the holding-inner peripheral part of the outer ring is moved by the operation means along a locus of a circle, the radius of which is the eccentricity to the rotation center of the inner rotor.

As a second aspect of the present invention, the present inventor has solved the above problem by providing the internal gear pump according to the first aspect, wherein in contacting and sliding between the pins and the cam protruded parts, the pins are brought into point contact with the cam protruded parts at the same portions thereof. As a third aspect of the present invention, the present inventor has solved the above problem by providing the internal gear pump according to the first or second aspect, wherein the pins are formed in an arc shape at portions that are brought into contact with the cam protruded parts.

As a fourth aspect of the present invention, the present inventor has solved the above problem by providing the internal gear pump according to any one of the first to third aspects, wherein the pins are formed in a circular cylindrical shape. As a fifth aspect of the present invention, the present inventor has solved the above problem by providing the internal gear pump according to any one of the first to fourth aspects, wherein the pins are formed of iron alloy.

As a sixth aspect of the present invention, the present inventor has solved the above problem by providing the internal gear pump according to any one of the first to fifth aspects, wherein a space is provided between the pins and inner periphery side surface of the rotor chamber. As a seventh aspect of the present invention, the present inventor has solved the above problem by providing the internal gear pump according to any one of the first to sixth aspects, wherein stopper wall surface parts with which the cam protruded parts are brought into contact are formed to regulate an oscillation angle of the outer ring to within a predetermined range.

As an eighth aspect of the present invention, the present inventor has solved the above problem by providing the internal gear pump according to the first aspect, wherein in contacting and sliding between the pins and the cam protruded parts, the pins are brought into point contact with the cam protruded parts while turning. As a ninth aspect of the present invention, the present inventor has solved the above problem by providing the internal gear pump according to the eighth aspect, wherein the pins are turnably installed in the rotor chamber. As a tenth aspect of the present invention, the present inventor has solved the above problem by providing the internal gear pump according to the eighth aspect, wherein the pins are configured by supporting pillar parts and collar parts, and the collar parts are formed in a cylindrical shape and are turnably installed on the supporting pillar parts. As an eleventh aspect of the present invention, the present inventor has solved the above problem by providing the internal gear pump according to the eighth aspect, wherein the pins are configured by supporting pillar parts and collar parts, and the collar parts are configured as ball bearings.

According to the present invention, the outer ring that moves the outer rotor includes the holding-inner peripheral part for rotatably holding the outer rotor, and at least three cam protruded parts formed at predetermined intervals along a circumferential direction of an outer periphery surface. In the rotor chamber of the pump housing, pins are formed by the same number as that of the cam protruded parts of the outer ring. The respective pins are always brought into contact with corresponding cam protruded parts.

In the present invention, because the outer ring is oscillated by the operation means, and also because the cam protruded parts of the outer ring are configured to be always brought into contact with the pins, the outer ring can move by being guided along a predetermined locus (a locus of a circle) following the shape of the cam protruded parts that are brought into contact with the pins. Accordingly, a discharge quantity of the internal gear pump can be adjusted.

Based on the above configuration of the internal gear pump according to the present invention, the outer ring is not moved by being guided by convex shape parts or concave shape parts of the inner periphery wall of the rotor chamber of the pump housing, but is moved by being guided by the cam protruded parts formed in the outer ring that are normally brought into contact with the pins. The pins are installed in the rotor chamber as members separate from the pump housing. Therefore, because the pins are installed at only predetermined positions in the rotor chamber, oscillation movement of the outer ring is performed extremely accurately.

The internal gear pump according to the present invention is not a type that the outer ring is moved by being guided by the convex shape parts or concave shape parts of the inner periphery wall of the rotor chamber. Because the outer ring and the inner periphery wall of the rotor chamber are not in contact with each other, high dimensional precision is not required to manufacture the inner periphery wall of the rotor chamber. Further, the inner periphery wall of the rotor chamber can be manufactured by only casting, and it is not necessary to perform cutting to manufacture the inner periphery wall of the rotor chamber. Therefore, a processing of accurately cutting at only a position of a hole for installing the pins can be performed at remarkably lower cost, in higher precision, and in a shorter manufacturing time, instead of cutting the inner periphery wall of the casing in a complex curve as required by the prior art.

BRIEF DESCRIPTION OF THE DRAWINGS

FIG. 10 is an enlarged view of a portion (β) in FIG. 1A.

FIG. 2A is an enlarged view of an operation state of an outer ring, an outer rotor, and an inner rotor, and FIG. 2B is an enlarged view of a portion (ε) in FIG. 2A;

DESCRIPTION OF THE PREFERRED EMBODIMENTS

Figure 1A:
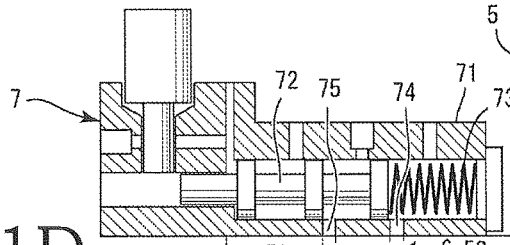
FIG. 1A is a front view showing a configuration of an inside of an internal gear pump according to the present invention.
Figure 1B:
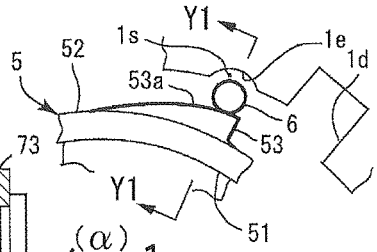
FIG. 1B is an enlarged view of a portion (α) in FIG. 1A.
Figure 1D:
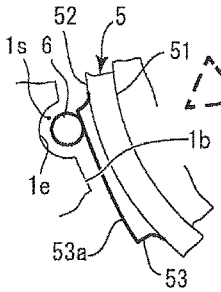
FIG. 1D is an enlarged view of a portion (γ) in FIG. 1A.
Figure 1D:
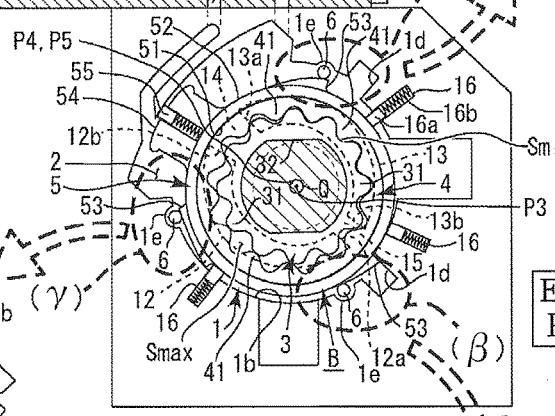
Figure 1C:
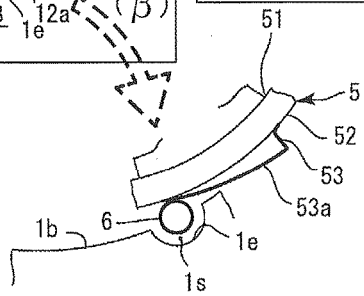
FIG. 1E is a front view of a pump housing.
FIG. 1F is a cross-sectional view of a portion of FIG. 1B along an arrowhead line Y1-Y1.

Hereinafter, an embodiment of the present invention is described with reference to the drawings. As shown in FIG. 1A, FIGS. 2A and 2B, etc., an internal gear pump according to the present invention is mainly configured by a pump housing A, an inner rotor 3, an outer rotor 4, guiding means B, and operation means 7. The guiding means B is configured by an outer ring 5, and pins 6.

Figure 1E:
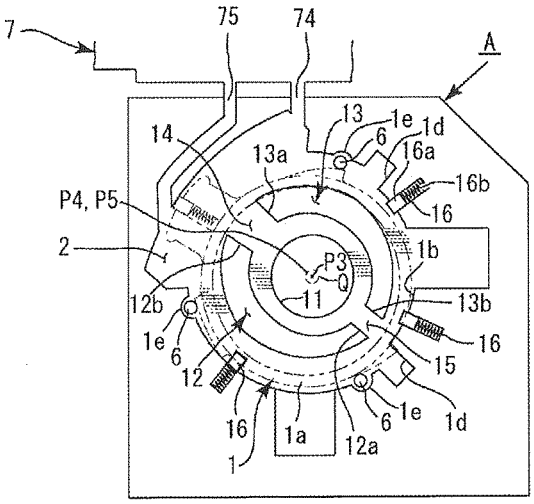
Figure 1F:
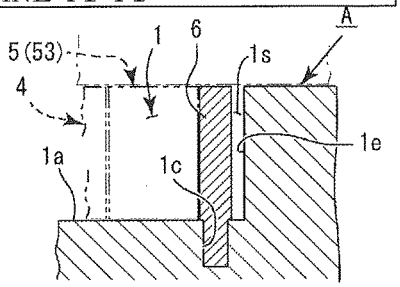
Figure 3A:
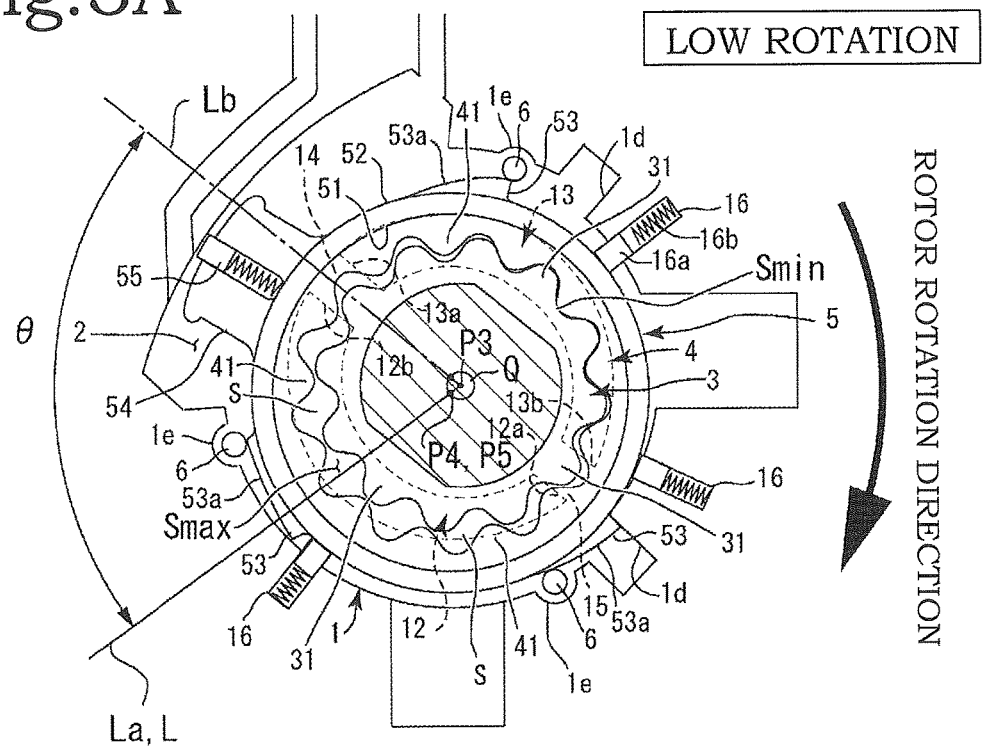
FIG. 3A is a view of a state that the outer rotor is positioned on an initial base line relative to the inner rotor at a low rotation time.
Figure 3B:
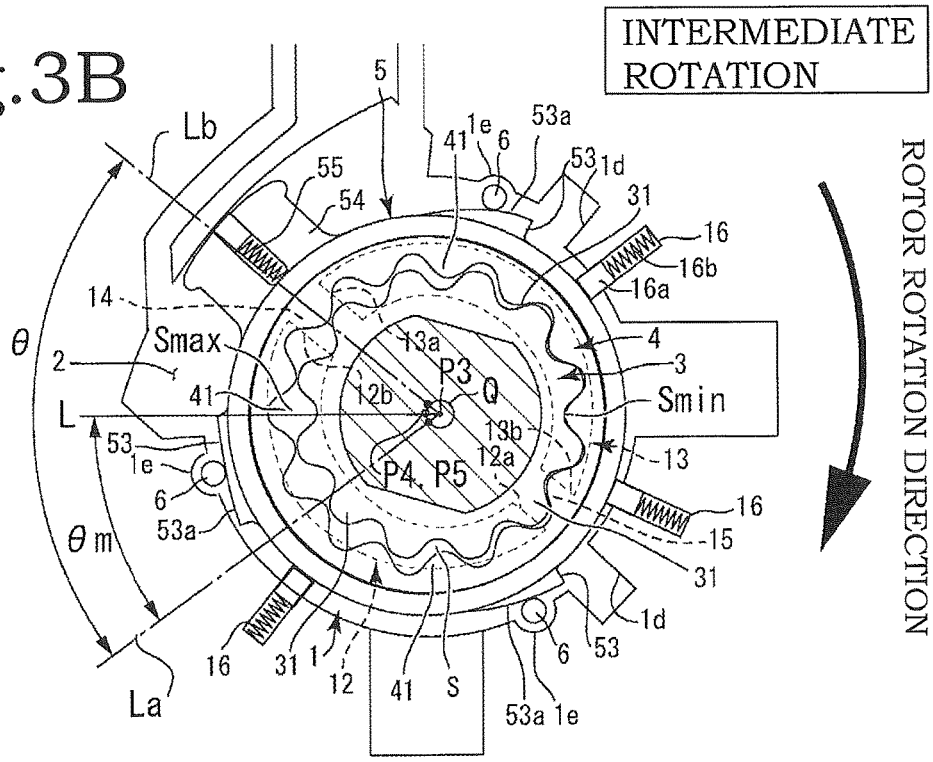
FIG. 3B is a view of a state that the outer rotor moved from the initial base line based on oscillation of the outer ring to the inner rotor at an intermediate rotation time.

As shown in FIGS. 1A and 1E, a rotor chamber 1 and an operation chamber 2 are formed in the pump housing A. A shaft hole 11 in which a drive shaft for driving the pump is formed on a bottom surface 1*a* of the rotor chamber 1. A suction port 12 and a discharge port 13 are formed around the shaft hole 11. A partition part is formed between the suction port 12 and the discharge port 13.

The partition part is formed at two positions in the rotor chamber 1. One of the partition parts is positioned between a terminal edge part 12*b* of the suction port 12 and a start edge part 13*a* of the discharge port 13. This partition part is referred to as a first partition part 14 (see FIG. 1E). The other partition part is positioned between a terminal edge part 13*b* of the discharge port 13 and a start edge part 12*a* of the suction port 12. This partition part is referred to as a second partition part 15 (see FIG. 1E).

In the rotor chamber 1, there are installed an inner rotor 3, an outer rotor 4, and an outer ring 5 (see FIG. 1A, FIG. 2A, etc.). In the operation chamber 2, there are installed, for example, members that configure the operation means 7. The rotor chamber 1 and the operation chamber 2 are communicated with each other. The surrounding of the bottom surface 1*a* is an inner periphery side surface 1*b*.

The inner rotor 3 is a gear having a trochoid shape or approximately a trochoid shape. In the description of the present invention, rotation directions of the inner rotor 3 and the outer rotor 4 are clockwise directions. The inner rotor 3 is formed with a plurality of outer teeth 31. A boss hole 32 for a drive shaft is formed in a non-circular shape at a diameter-direction center position. The drive shaft is pierced through and is fixed in the boss hole 32. A shaft-fixing part in approximately the same shape as that of the boss hole 32 is fixed to the drive shaft by means of fixing such as pressuring, so that the drive shaft is fixed to the inner rotor 3. The inner rotor 3 is rotated by rotation drive of the drive shaft.

The outer rotor 4 is formed in a ring shape, and is formed with a plurality of inner teeth 41 at an inner periphery side of the outer rotor 4. Number of the outer teeth 31 of the inner rotor 3 is configured to be smaller by one than number of the inner teeth 41 of the outer rotor 4. A plurality of inter-teeth spaces S are configured by the outer teeth 31 of the inner rotor 3 and the inner teeth 41 of the outer rotor 4. When the inter-teeth space S passes through the first partition part 14, a closed space is configured, and the closed space becomes a maximum inter-teeth space Smax having a maximum volumetric capacity.

A rotation center of the inner rotor 3 is designated as P3 (see FIGS. 2A and 2B). The rotation center P3 is at a fixed position relative to the rotor chamber 1. A rotation center of the outer rotor 4 is designated as P4. A virtual line that connects between the rotation center P3 and the rotation center P4 is referred to as a base line L. The base line L is operated by the guiding means B and the operation means 7 between an initial base line La and a terminal base line Lb to be described later, and oscillates in a circumferential direction around the rotation center P3 of the inner rotor 3.

The rotation center P3 of the inner rotor 3 is separated from the rotation center P4 of the outer rotor 4, and a distance of this separation is referred to as eccentricity e. The eccentricity e is for maintaining an optimum chip clearance between the inner teeth 41 and the outer teeth 31 by allowing the inner rotor 3 and the outer rotor 4 to rotate by always maintaining a constant distance between the rotors (see FIGS. 2A and 2B).

The guiding means B is for oscillating the outer rotor 4 from the initial base line La to the terminal base line Lb of the base line L in a range of an angle θ (see FIGS. 3A and 3B to FIGS. 5A and 5B). The guiding means B is configured by the outer ring 5 and the pins 6. The outer ring 5 is for changing the angle of the base line L by oscillating the rotation center P4 of the outer rotor 4. The outer ring 5 is formed in approximately a ring shape, and an inner periphery side of the outer ring 5 is referred to as a holding-inner peripheral part 51. Further, on the outer ring 5, an oscillation-operation protruded part 54 to be oscillated by the operation means 7 described later is formed in stretch from an outer periphery side surface to a diameter outside direction (see FIGS. 1A and 3A).

The holding-inner peripheral part 51 is a circular inner wall surface. An internal diameter of the holding-inner peripheral part 51 is the same as an external diameter of the outer rotor 4. Actually, the internal diameter of the holding-inner peripheral part 51 is slightly larger than the external diameter of the outer rotor 4. In order to enable the outer rotor 4 to rotate smoothly, the outer rotor 4 is inserted into the holding-inner peripheral part 51, with a clearance between the holding-inner peripheral part 51 and the outer rotor 4. This configuration is also included in the same concept.

That is, a diameter center P5 of the holding-inner peripheral part 51 of the outer ring 5 is configured to match the rotation center P4 of the outer rotor 4 in a state that the outer rotor 4 is inserted into the holding-inner peripheral part 51 (see FIGS. 2A and 2B). Based on the formation of the outer ring 5 in the rotor chamber 1, the outer rotor 4 is arranged in the holding-inner peripheral part 51, and is supported in a stable state. At the same time, the outer ring 5 and the outer rotor 4 are oscillated along a locus Q of a circle of which a radius is the eccentricity e to the rotation center P3 of the inner rotor 3 via the operation means 7 described later (see FIGS. 3A and 3B and FIGS. 4A and 4B).

The outer ring 5 is installed in the rotor chamber 1 of the pump housing A, and is configured to be able to oscillate freely in the rotor chamber 1. For this purpose, the rotor chamber 1 is formed to be slightly wider than an external shape of the outer ring 5, and a space in which the outer rotor 4 oscillates is additionally provided.

A locus of the oscillation of the outer ring 5 is determined. The diameter center P5 of the outer ring 5 oscillates along the locus Q of a circle of which a radius is the eccentricity e to the rotation center P3 of the inner rotor 3 (see FIGS. 2A and 2B). The eccentricity e is a distance of separation between the rotation center P3 of the inner rotor 3 and the rotation center P4 of the outer rotor 4, as described above. Because the internal diameter of the holding-inner peripheral part 51 of the outer ring 5 and the external diameter of the outer rotor 4 are approximately equal to each other, the diameter center P5 of the holding-inner peripheral part 51 and the rotation center P4 of the outer rotor 4 inserted into the holding-inner peripheral part 51 are in a matched state.

Therefore, based on the oscillation of the outer ring 5, the rotation center P4 of the outer rotor 4 oscillates around the rotation center P3 along the locus Q of a circle while maintaining the eccentricity e to the rotation center P3 of the inner rotor 3. Accordingly, the angle of the base line L connecting between the rotation center P3 and the rotation center P4 also changes (see FIGS. 2A and 2B).

In the present invention, because the outer rotor 4 oscillates to the inner rotor 3, the outer rotor 4 has an initial position and a terminal position of the oscillation. The initial position is in a state that the base line L matches the initial base line La. In this state, the maximum inter-teeth space Smax having a maximum volumetric capacity among the inter-teeth spaces S formed by the outer teeth 31 of the inner rotor 3 and the inner teeth 41 of the outer rotor 4 passes through the suction port 12 (see FIGS. 2A and 3A).

The terminal position is in a state that the base line L matches the terminal base line Lb. In this state, a position of the maximum inter-teeth space Smax passes on the terminal base line Lb, and the maximum inter-teeth space Smax passes on the first partition part 14 (see FIG. 4B).

An angle at which the outer ring 5 actually oscillates from the initial position to the terminal position is designated as θ', and an angle formed by the initial base line La and the terminal base line Lb is designated as θ. The angle θ' becomes smaller than the angle θ. That is, based on slight movement of the oscillation-operation protruded part 54 of the outer ring 5 by the operation means 7, a relative angle between the inner rotor 3 and the outer rotor 4 can be large changed over a range from the initial base line La to the terminal base line Lb (see FIGS. 2A and 2B).

At least three cam protruded parts 53 are formed at predetermined intervals along a circumferential direction of the outer periphery surface 52 of the outer ring 5. The cam protruded parts 53 are portions that are brought into contact with the pin 6 described later and that also slide to the pins 6 (see FIGS. 1A to 1E, FIG. 2A, FIGS. 5A and 5B, etc.). Specifically, the cam protruded parts 53 are formed at approximately equal intervals in a circumferential direction of the outer periphery surface 52 of the outer ring 5. In a case where three cam protruded parts 53 are formed, the cam protruded parts 53 are formed at intervals of an angle of about 120 degrees.

The cam protruded parts 53 are formed within a predetermined range of the outer periphery surface 52 in a circumferential direction. This range is approximately equivalent to a range over which the outer ring 5 slides to the pins 6 when the outer ring 5 slides to a maximum extent. The cam protruded parts 53 are formed with cam sliding surfaces 53*a*. The cam sliding surface 53*a* of each cam protruded part 53 is formed in a shape of an inclined surface that is gradually separated from the outer periphery surface 52 from one end toward the other end along the circumferential direction.

Specifically, the cam sliding surface 53*a* is formed in a curve similar to a trochoid curve based on the outer periphery surface 52. Inclined directions of adjacent cam protruded parts 53 are not necessarily the same as that in the circumferential direction and are opposite in some cases. A shape of the cam sliding surface 53*a* of each cam protruded part 53 is not limited to a trochoid curve shape, and is formed as a flat inclined surface in some cases. Although number of the cam protruded parts 53 is set as three, more cam protruded parts 53 are formed in some cases.

The pins 6 are installed on the bottom surface 1*a* of the rotor chamber 1, by the same number as that of the cam protruded parts 53 of the outer ring 5. The plurality of pins 6 are provided to surround the outer ring 5 and to be always brought into contact with the corresponding cam protruded parts 53 (see FIG. 2A, and FIGS. 3A and 3B to FIGS. 5A and 5B). By the operation means described later, positions of the respective pins 6 are set and shapes of the cam sliding surfaces 53*a* are set so that the diameter center P5 of the holding-inner peripheral part 51 of the outer ring 5 moves along the locus Q of a circle of which a radius is the eccentricity e to the rotation center P3 of the inner rotor 3.

A plurality of embodiments are present for the pins 6. For the pins 6 according to a first embodiment, a circular cylindrical shape with a circular cross section, a columnar shape or a shaft is used. Because the pins 6 are formed in circular shapes in the cross section, portions of the pins 6 that are brought into contact with the cam sliding surfaces 53*a* of the cam protruded parts 53 of the outer ring 5 are always the same portions, and are also in approximately point contact (see FIGS. 1A, 1B, 1C, 1D, and FIGS. 2A and 2B). By arranging such that the pins 6 are brought into approximately point contact with the same portions of the cam sliding surfaces 53*a* of the cam protruded parts 53, ranges that require high dimensional precision can be minimized.

In the present invention, the point contact refers to a state of contact between the pins 6 and the cam protruded parts 53 when looked at from the front of the invention. The point contacts between the pins 6 and the cam protruded parts 53 become linearly continuous from the front toward a depth direction (or when looked at from a side surface) of the invention.

That is, when the point contacts between the pins 6 and the cam protruded parts 53 are looked at three-dimensionally, the point contacts become a line contact that is continuous in the depth direction. Therefore, the point contacts between the pins 6 and the cam protruded parts 53 in the present invention also include a concept of a line contact (including an approximate line contact).

A point contact state that is looked at from the front of the present invention is specifically described in FIGS. 1A to 1D, FIG. 2A, FIGS. 3A and 3B to FIGS. 5A and 5B, FIGS. 7A and 7B, FIGS. 8A and 8B, and FIG. 9A. A state of a line contact in a linear shape along the front surface toward a depth direction (or a side surface) in the present invention is shown in FIG. 1F, FIG. 8C, and FIGS. 9B to 9D.

There is also another mode that the pins 6 have arc shapes at only portions that are brought into contact with the cam sliding surfaces 53*a* of the cam protruded parts 53. In this mode, a cross-sectional shape that is orthogonal with a longitudinal direction is not circular, but a portion thereof is formed in a semicircular shape, and the rest portion thereof is formed in a rectangular shape (see FIG. 7A). There is also a case that cross-sectional shapes of the pins 6 that are orthogonal with a longitudinal direction are set in triangular shapes so that the pins 6 are brought into point contact with the cam sliding surfaces 53*a* of the cam protruded parts 53 (see FIG. 7B).

In the present invention, a locus of movement of the outer ring 5 is determined by shapes of the cam sliding surfaces 53*a*. Because the pins 6 are pressing members, it is sufficient that the pins 6 are being pressed from the outside of the cam sliding surfaces 53*a* of the outer ring 5. Consequently, a degree of freedom of designing shapes of the pins 6 can be enhanced. The pins 6 are made of a member different from that of the pump housing A. A fitting hole 1*c* is formed on the bottom surface 1*a* of the rotor chamber 1. One end of each pin 6 in the longitudinal direction is embedded into the fitting hole 1*c* by fixing means such as pressing means, so that the pin 6 is installed on the bottom surface 1*a* of the rotor chamber 1. Accordingly, different materials can be selected, such as casted aluminum can be selected for the pump housing A, and iron alloys can be selected for the pins 6. In this case, the iron alloys are steel materials or the like. By using casted aluminum for the pump housing A, and by using a steel material for the pins 6, the device as a whole can be light-weighted, and strength of the pins 6 that require most durability can be improved.

The pins 6 and the inner periphery side surface 1*b* of the rotor chamber 1 are separated from each other, and the space is provided at this separated portion. The space is the separated portion between the pins 6 and the inner periphery side surface 1*b*. To form the separated portion, an approximately semicircular concave-wall surface part 1*e* is formed on the inner periphery side surface 1*b* (see FIGS. 1B, 1C, and 1D). The space is can be configured at each installation position of the pin 6, without increasing a size of the rotor chamber 1.

Based on the provision of the space 1*s*, even when contaminants (abnormalities) and the like in the oil are adhered to the sliding parts as positions where the pins 6 and the cam protruded parts 53 of the outer ring 5 are brought into contact with each other, the contaminants (abnormalities) do not stay at portions of the pins 6, and the contaminants (abnormalities) pass through the space 1*s*. As a result, the contaminants can be suppressed from staying. Accordingly, movement of the outer ring 5 can be set always smooth.

On the inner periphery side surface 1*b* of the rotor chamber 1, stopper wall surface parts 1*d* with which the cam protruded parts 53 are brought into contact are formed to regulate an oscillation angle of the outer ring 5 to within a predetermined range. Specifically, portions that become steps in a circumferential direction are formed on the inner periphery side surface 1*b*. The stepped portions are used as the stopper wall surface parts 1*d*. When the outer ring 5 slides to a maximum extent in the circumferential direction, the cam protruded parts 53 are brought into contact with the stopper wall surface parts 1*d*, and the outer ring 5 cannot oscillate any more.

Figure 6:
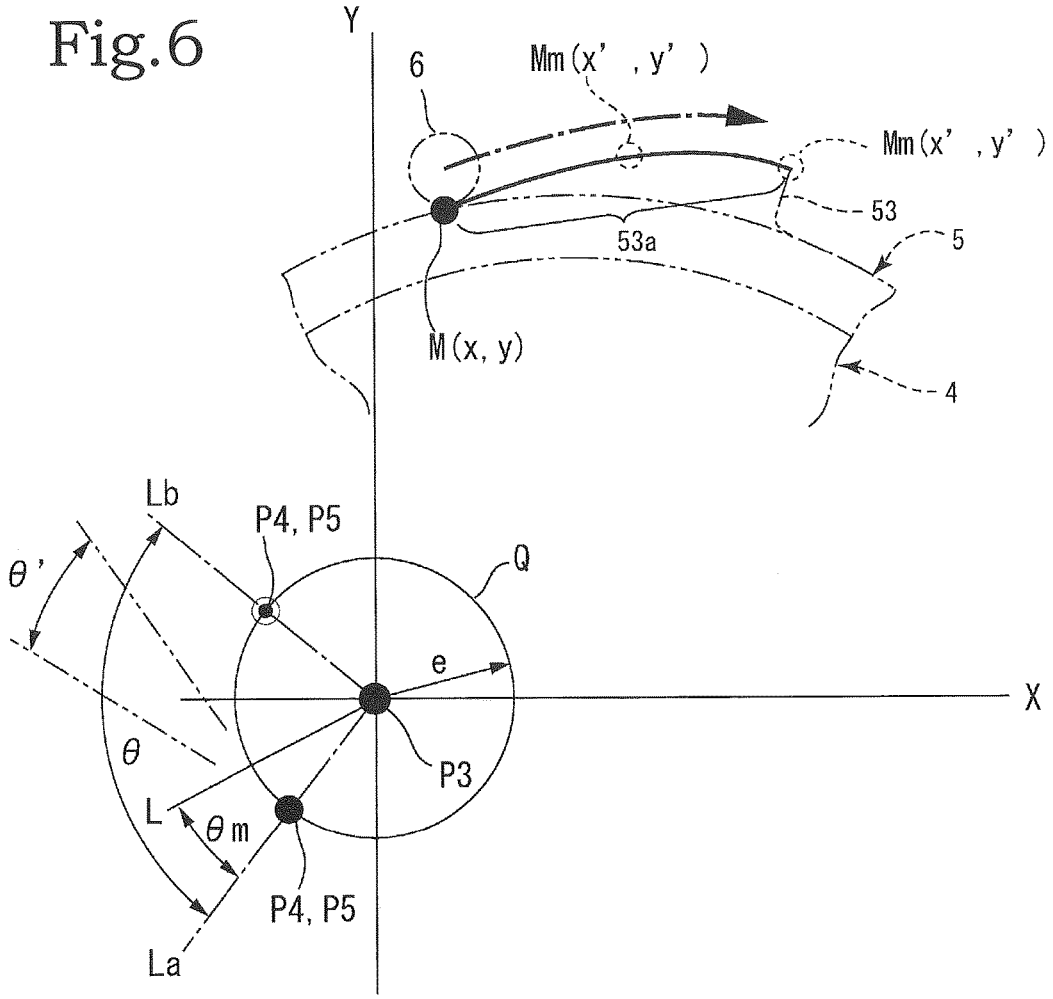
FIG. 6 is an enlarged view of a configuration of a cam sliding surface of a cam protruded part.
Figure 7A:
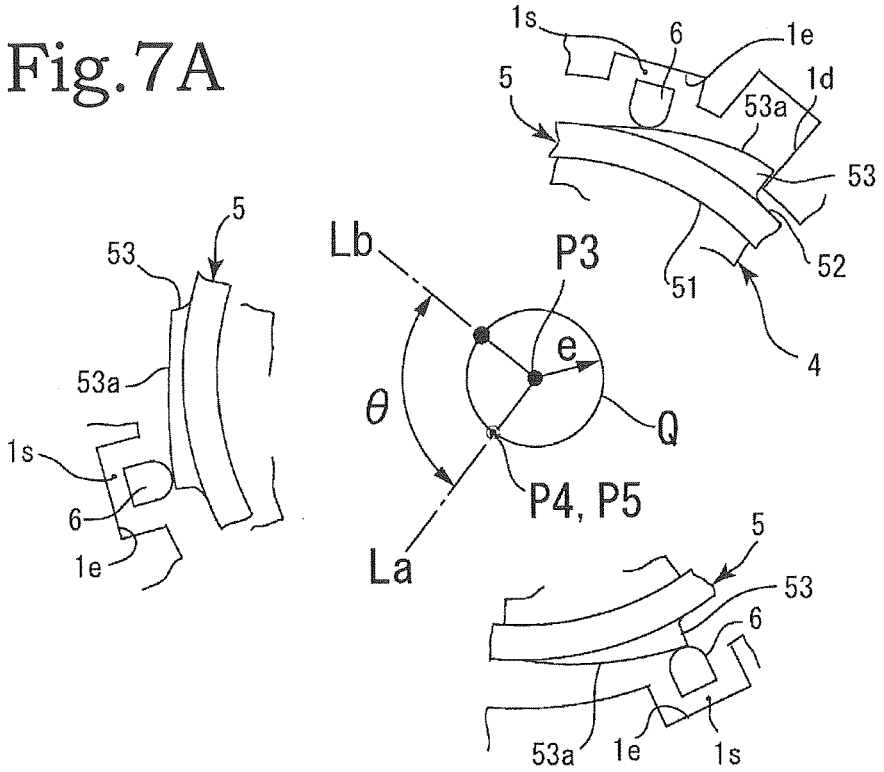
FIG. 7A is an enlarged front view of a relevant part of the present invention in which pins according to another mode are used.
Figure 7B:
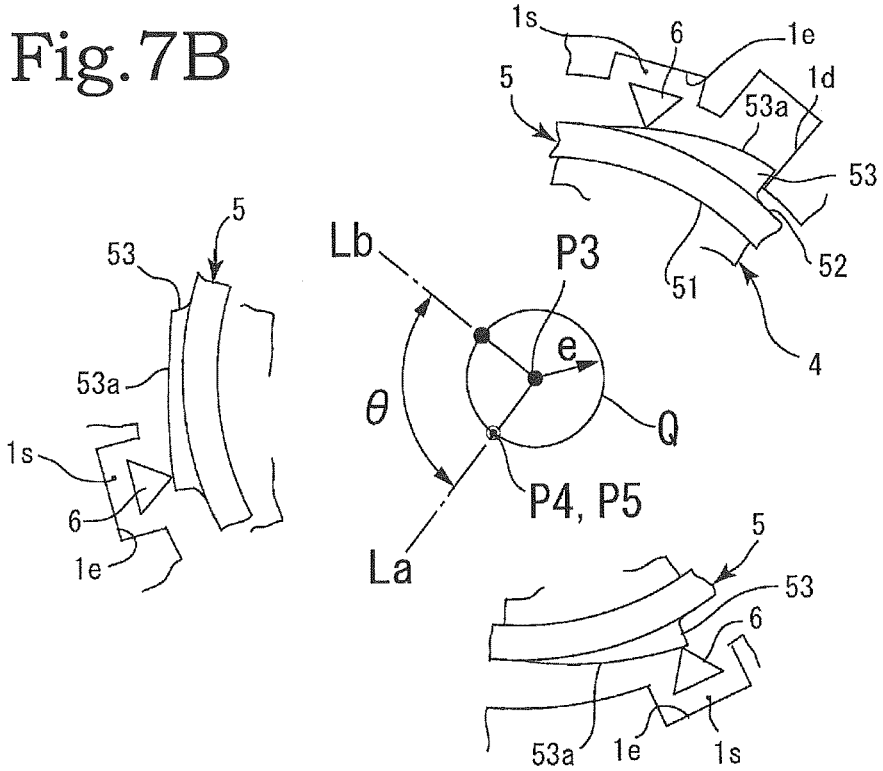
FIG. 7B is an enlarged front view of a relevant part of the present invention in which pins according to still another mode are used.

Shapes of the cam sliding surfaces 53*a* of the corresponding cam protruded parts 53 of the outer ring 5 are drawn based on the following equations (see FIG. 6). First, the rotation center P3 of the inner rotor 3 is set as an origin or X and Y coordinates of (0, 0). Next, coordinates of a point M at which the cam sliding surface 53*a* and the pins 6 are brought into contact with each other at the initial position (at a low rotation time) of the outer ring 5 are set as (x, y). The coordinates of the point M are at a position where the outer rotor 4 and the outer ring 5 are in the initial state (see FIGS. 2A and 2B), and the maximum inter-teeth space Smax is present on the initial base line La. Then, the base line L moves by an arbitrary angle from a position of the initial base line La. When a variable at this angle of movement is designated as θm, coordinates (x', y') at a moved point Mm become as follows.

Arbitrary x' is as follows:

$$x'=(x+e^*\cos\theta m)^*\cos(\theta m^*k)-(y-e^*\cos\theta m)^*\sin(\theta m^*k).$$

Arbitrary y' is as follows:

$$y'=(x+e^*\cos\theta m)^*\cos(\theta m^*k)+(y-e^*\cos\theta m)^*\cos(\theta m^*k)+e.$$

The angle θm gradually increases, and a locus of movement of the coordinates (x', y') of the point Mm formed by the movement of the base line L from the initial base line La to the terminal base line Lb determines the shape of the cam sliding surface 53*a* of the cam protruded part 53 (see FIG. 6). The cam sliding surface 53*a* formed by the above equations is applied to all the three cam protruded parts 53.

A rotation angle θ' of the outer ring 5 is expressed as $$\theta'=k\theta m.$$

In this case, k represents a shortening coefficient. When a value of the shortening coefficient k is smaller, proportionately a rotation angle of the outer rotor 4 can be set larger than a rotation angle of the outer ring 5. A detailed preferable value of the shortening coefficient k is $$0.3\leq k<1.$$

Therefore, the cam sliding surfaces 53*a* of the cam protruded parts 53 of the outer ring 5 have shapes to satisfy the above equation. While oscillating in contact with the pins 6, the diameter center P5 of the outer ring 5 moves along the locus Q of a circle (see FIGS. 5A and 5B).

When the inner rotor 3 and the outer rotor 4 are at the initial position, the initial base line La passes through an intermediate position of the suction port 12 in a circumferential direction. In the suction port 12, the inter-teeth space S becomes the maximum inter-teeth space Smax, and the inter-teeth space S becomes a minimum deepest engagement part Smin in the discharge port 13.

When the inner rotor 3 and the outer rotor 4 are at the terminal position, the maximum inter-teeth space Smax having a maximum volumetric capacity of the inter-teeth space S and the deepest engagement part Smin having a minimum volumetric capacity move onto the terminal base line Lb. Therefore, the inter-teeth space S becomes maximum in the first partition part 14, and at the same time, becomes minimum in the second partition part 15.

For the operation means 7, there are used a solenoid valve type, a hydraulic valve type, etc. The operation means 7 directly applies a hydraulic pressure to the oscillation-operation protruded part 54 of the outer ring 5 to operate the oscillation-operation protruded part 54, and oscillates the outer ring 5 to a circumferential direction. The operation means 7 has a valve 72 and a spring 73 installed in a valve pump housing 71, and further has two flow paths 74 and 75 (see FIGS. 1A and 1E).

The oscillation-operation protruded part 54 of the outer ring 5 is formed to project from the outer periphery surface 52 to an external side in a diameter direction. The oscillation-operation protruded part 54 is arranged in the operation chamber 2 adjacent to and communicated with the rotor chamber 1.

In the operation chamber 2, the oscillation-operation protruded part 54 has hydraulic-pressure receiving surfaces at both sides in a width (circumferential) direction. The oscillation-operation protruded part 54 has a structure of dividing in watertight the operation chamber 2 into two. Therefore, the oscillation-operation protruded part 54 includes a sealing member 55 having a spring. The oscillation-operation protruded part 54 divides in watertight the operation chamber 2 via the sealing member 55.

The two flow paths 74 and 75 of the operation means 7 are coupled to be communicated with each other from respectively separate positions. Oil is supplied from one of the flow paths 74 and 75, and is flown out from the other one of the flow paths 74 and 75. By oscillating the oscillation-operation protruded part 54 in a circumferential direction in the operation chamber 2, the outer ring 5 is oscillated.

An operation of the internal gear pump according to the present invention is described next. It is assumed that the valve 72 of the operation means 7 is operated by a hydraulic pressure and that the hydraulic pressure changes together with a discharge pressure of the pump. First, during a period from a pump start time to a low rotation time, the inner rotor 3 and the outer rotor 4 rotate by having respective outer teeth 31 and inner teeth 41 engaged with each other, following a rotation of the drive shaft. Then, a volumetric capacity of the inter-teeth space S expands in a former half of the suction port 12. The volumetric capacity is contracted after passing through a latter half of the suction port 12 and the first partition part 14. By changing the volumetric capacity in this way, a pump operation is performed.

When a pump discharge pressure is zero or is extremely low before starting the pump or immediately after starting the pump, the base line L indicating a position of the outer rotor 4 relative to the rotation center P3 of the inner rotor 3 is on the initial base line La. According, when the inner rotor 3 and the outer rotor 4 are in an initial position state, a pump discharge quantity becomes minimum (see FIGS. 3A and 5A).

The rotors become in an intermediate rotation state following an increase in the pump rotation number, and when a pump discharge pressure increases, the operation means 7 operates, and the oil flows from the flow path 75 to the operation chamber 2. The outer ring 5 starts oscillating in the same direction (in the clockwise direction in the present invention) as the rotations of the inner rotor 3 and the outer rotor 4 (see FIGS. 3B and 4A). Accordingly, the base line L moves by the angle θm from the initial base line La, and approaches the terminal base line Lb. The angle θm is a variable.

Figure 4A:
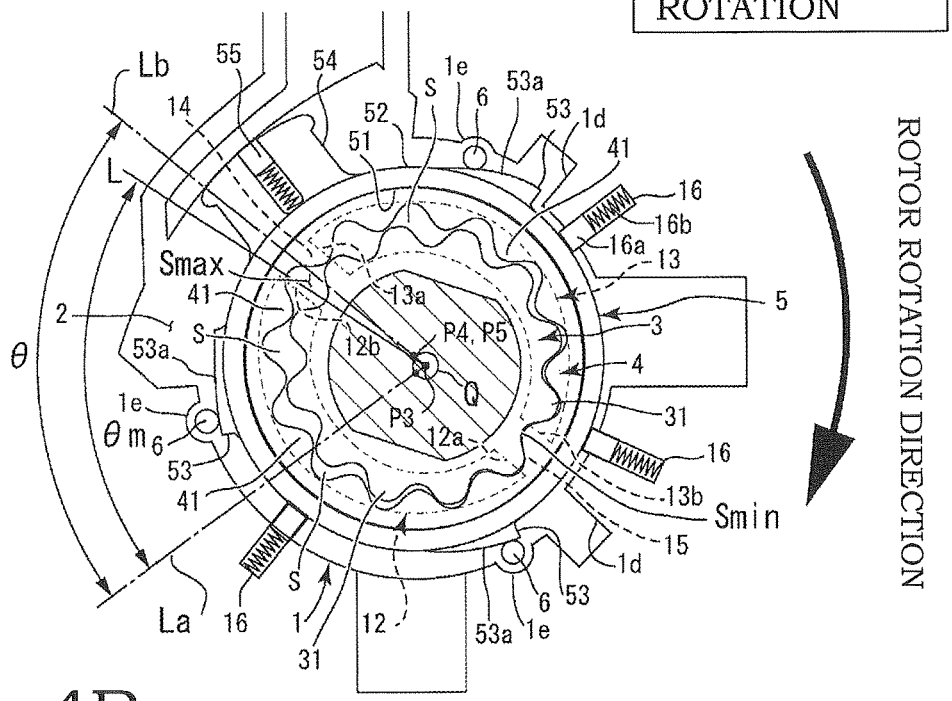
FIG. 4A is a view of a state that the outer rotor is moving from a position of the initial base line to the inner rotor at the intermediate rotation time.
Figure 4B:
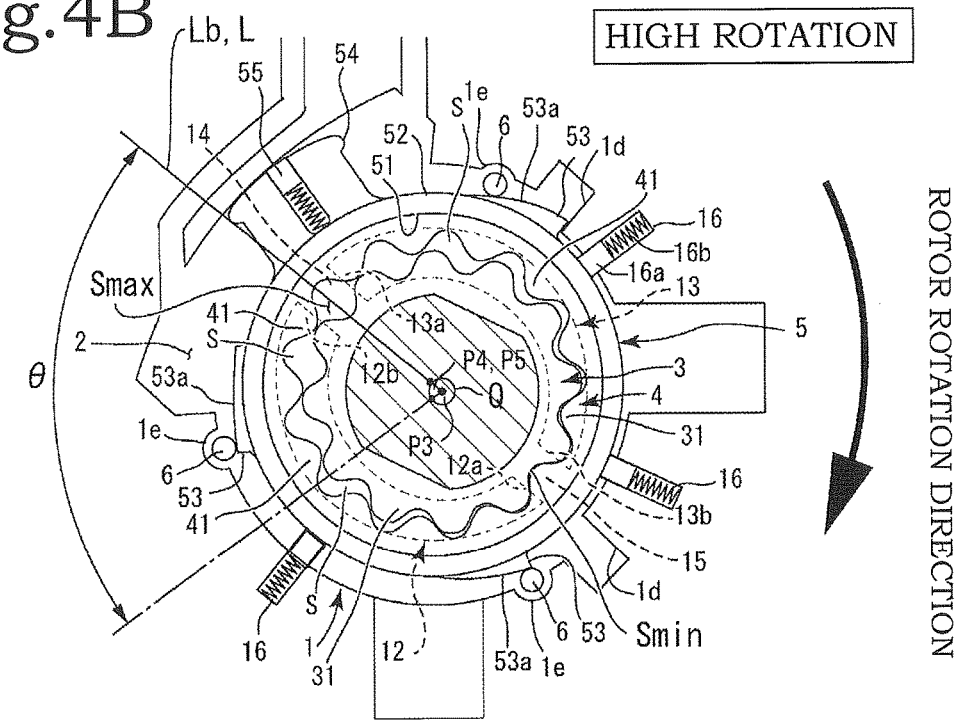
FIG. 4B is a view of a state that the outer rotor reached a terminal base line based on sliding of the outer ring to the inner rotor at a high rotation time.
Figure 5A:
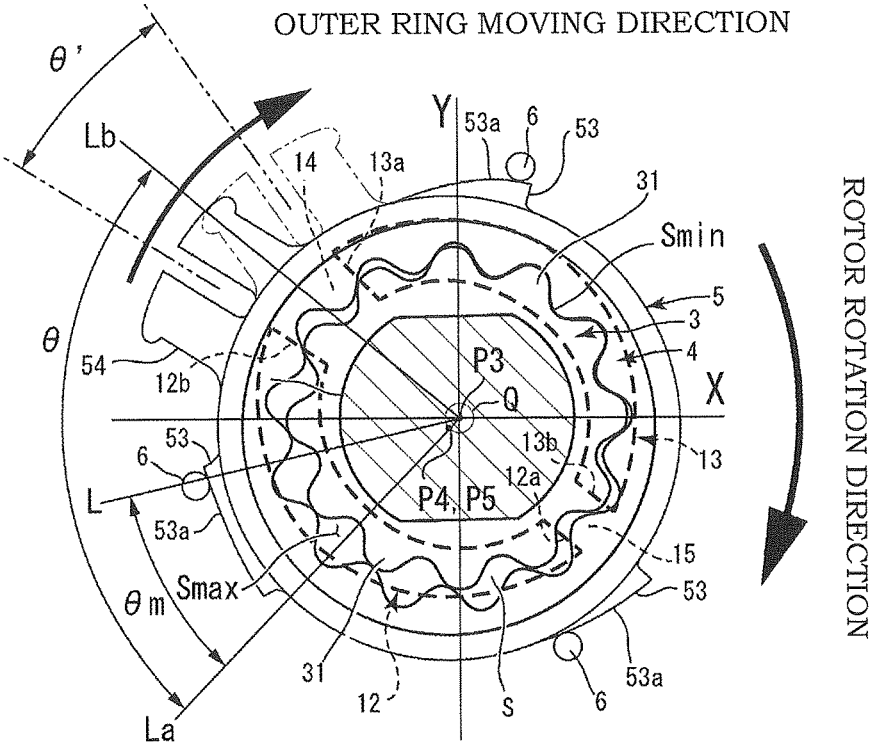
FIG. 5A is a view of the inner rotor, the outer rotor, and the outer ring at a low rotation time.
Figure 5B:
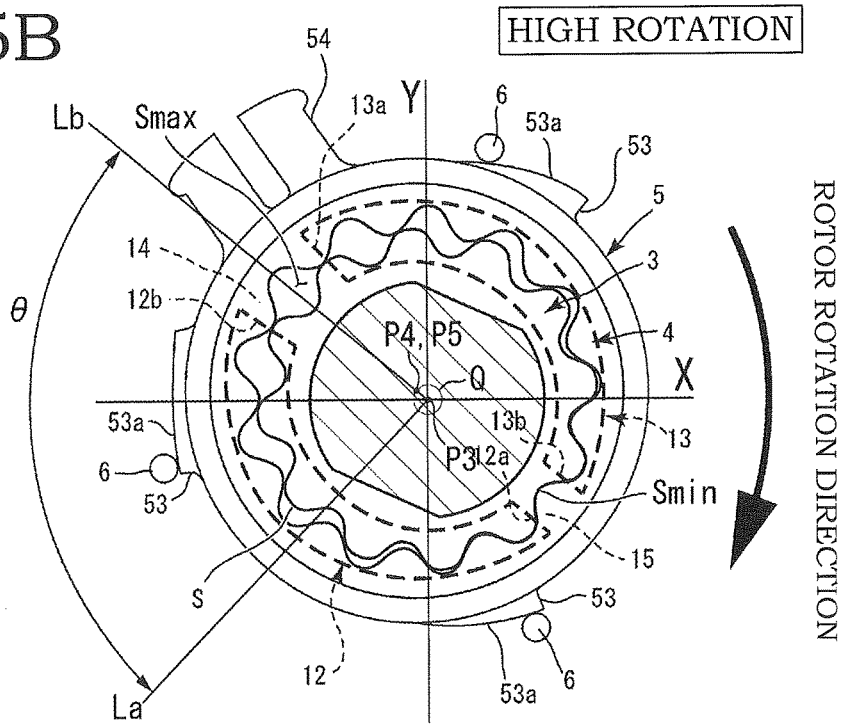
FIG. 5B is a view of the inner rotor, the outer rotor, and the outer ring at a high rotation time.

In a high rotation state when the base line L reaches the terminal base line Lb, a passing position of the maximum inter-teeth space Smax becomes on the first partition part 14 (see FIGS. 4B and 5B). The maximum inter-teeth space Smax passes through the first partition part 14 in a state that a volumetric capacity of the inter-teeth space S is maximum (see FIG. 4B). Therefore, in the high rotation state when the base line L matches the terminal base line Lb, a pump discharge quantity becomes maximum (see FIG. 5B).

In the present invention, the outer ring 5 into which the outer rotor 4 is rotatably inserted is oscillated in the rotor chamber 1 by the operation means 7. The outer ring 5 is moved to approximately a tangent direction of the rotor chamber 1 by the operation means 7, and the oscillation angle (the angle θ') of the operation means 7 is small. However, the outer ring 5 itself moves so that the diameter center P5 of the holding-inner peripheral part 51 moves along the locus Q of a circle of which a radius is the eccentricity e to the rotation center P3 of the inner rotor 3.

Therefore, in addition to the movement by the operation means 7 in the tangent direction of the rotor chamber 1, the diameter center P5 of the holding-inner peripheral part 51 of the outer ring 5 also moves in an up and down direction along the locus Q of a circle. Consequently, the rotation center P4 of the outer rotor 4 inserted into the outer ring 5 can be moved at a larger angle θ than the angle θ' at which the outer ring 5 is oscillated by the operation means 7 (see FIGS. 2A and 6A).

In a state of the initial position, the inter-teeth space S formed by the inner rotor 3 and the outer rotor 4 is small in the first partition part 14. However, based on the large movement of the rotation center P4, as the rotation number increases, phases of the inner rotor 3 and the outer rotor 4 are deviated, and the inter-teeth space S passes through the first partition part 14 in a maximum state. That is, based on this, along the increase in the rotation number, the inter-teeth space S of the initial base line La increases while moving toward the terminal base line Lb. The inter-teeth space S becomes in a maximum state in the terminal base line Lb, and a discharge quantity of the pump relative to the rotation number can be increased.

Further, pressing members 16 for elastically biasing the outer ring 5 at predetermined intervals are provided in the rotor chamber 1 (see FIGS. 1A and 2A). Each pressing member 16 is configured such that a pressing head part 16*a* elastically biases the outer periphery surface 52 of the outer ring 5 with a spring 16*b* so that contact pressures at positions where the cam protruded parts 53 and the corresponding pins 6 are brought into contact with each other become approximately equivalent to enable the outer ring 5 to oscillate smoothly. The pressing members 16 also have a function of sealing the oil.

In the present invention, while not particularly shown in the drawings, a covering member for covering the rotor chamber 1 of the pump housing A is included, and the pins 6 are installed on the covering member in some cases.

Pins 6 according to a second embodiment are described next with reference to FIGS. 8A to 8C and FIGS. 9A to 9D. The pins 6 according to the second embodiment are brought into point contact with the cam protruded parts 53 of the outer ring 5 while the pins 6 are turned toward the cam protruded parts 53, based on contacts and sliding between the pins 6 and the cam protruded parts 53.

That is, the outer ring 5 is oscillated while the pins 6 are brought into contact with the cam protruded parts 53 of the outer ring 5. Based on this, when the cam sliding surfaces 53*a* of the cam protruded parts 53 slide on the pins 6, outer periphery parts of the pins 6 are turned, and the cam protruded parts 53 and the pins 6 are brought into point contact with each other.

The pins 6 according to the second embodiment further include a plurality of types. A first type is described below. The pins 6 are configured by supporting pillar parts 61 and collar parts 62 (see FIGS. 8A to 8C and FIGS. 9A and 9B). Shaft ends of the supporting pillar parts 61 are fixed to the fitting holes 1*c* of the rotor chamber 1 by fixing means such as pressing, and the collar parts 62 are turnably installed at portions protruded from the bottom surface 1*a* of the supporting pillar parts 61.

The collar parts 62 are members formed in approximately a circular cylindrical shape having a hollow inside. An internal diameter of each collar part 62 is formed larger than an external diameter of each supporting pillar part 61 so that the collar part 62 is configured to be turnable around the supporting pillar part 61. With this configuration, when each cam protruded part 53 slides to the collar part 62 of the pin 6 based on the oscillation of the outer ring 5, the collar part 62 presses against the cam protruded part 53 while rotating.

Figure 8A:
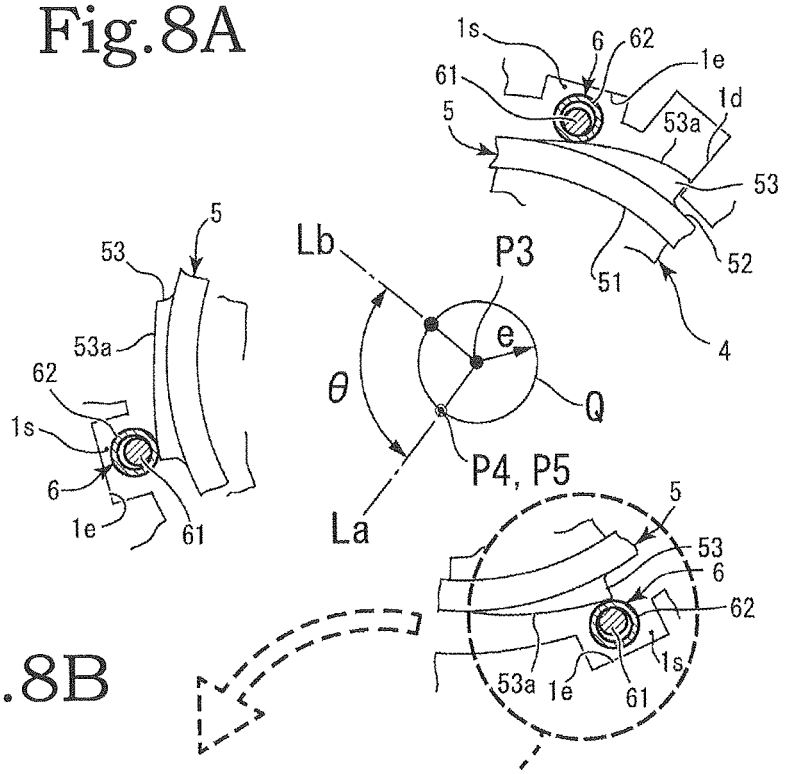
FIG. 8A is an enlarged front view, partially omitted and in cross section, of a relevant part of the present invention in which a first-type pin according to a second embodiment is used.
Figure 8B:
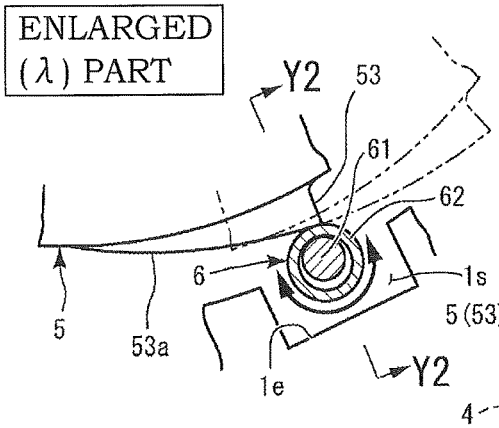
FIG. 8B is an enlarged view of a portion (λ) in FIG. 8A.
Figure 8C:
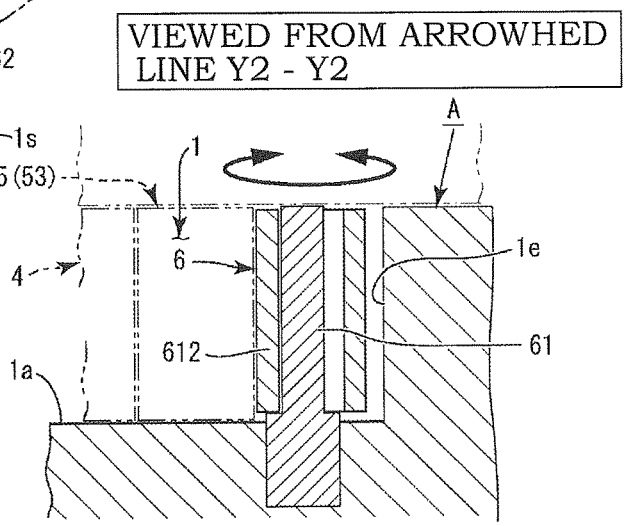
FIG. 8C is a cross-sectional view of a portion of FIG. 8B along an arrowhead line Y2-Y2.

The internal diameter of the collar part 62 is configured to be larger than the external diameter of the supporting pillar part 61 with a margin, and a relatively large gap is generated between the inner periphery side of the collar part 62 and the outer periphery side of the supporting pillar part 61 (see FIGS. 8A to 8C). Accordingly, the collar part 62 can turn smoothly.

Figure 9A:
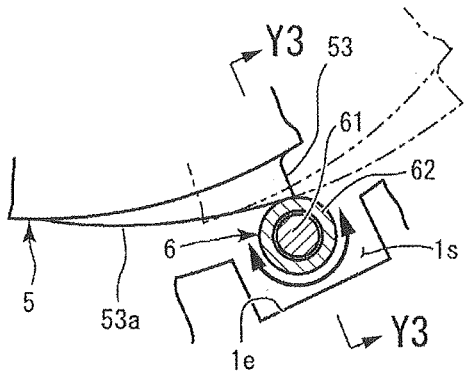
FIG. 9A is an enlarged front view, partially in cross section, of a relevant part of the present invention, in which two modifications of the first-type pin according to a second embodiment are used.
Figure 9B:
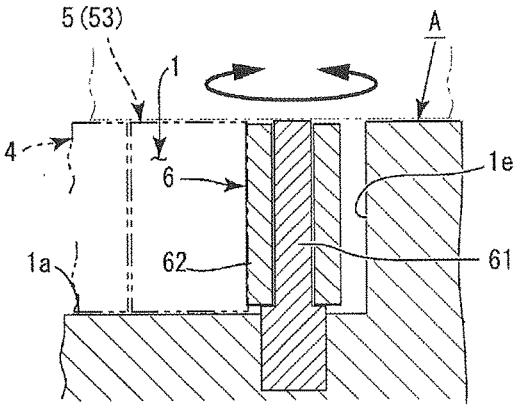
FIG. 9B is a cross-sectional view of a portion of FIG. 9A along an arrowhead line Y3-Y3.

The pins 6 of the first type have a modification that the internal diameter of each collar part 62 is slightly larger than the external diameter of each supporting pillar part 61 (see FIGS. 9A and 9B). A rotation center of the collar part 62 becomes at approximately the same position as that of a diameter center of the supporting pillar part 61. Accordingly, space saving can be achieved.

Figure 9C:
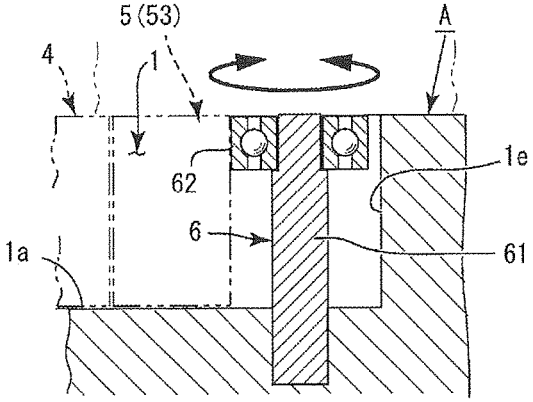
FIG. 9C is an enlarged front view of a relevant part of the present invention in which a second-type pin according to the second embodiment is used.

As the pins 6 of a second type, the pins 6 are configured by the supporting pillar parts 61 and the collar parts 62, like in the first type, and the collar parts 62 are ball bearings (see FIG. 9C). That is, the collar parts 62 as ball bearings are directly installed on the supporting pillar parts 61.

Figure 9D:
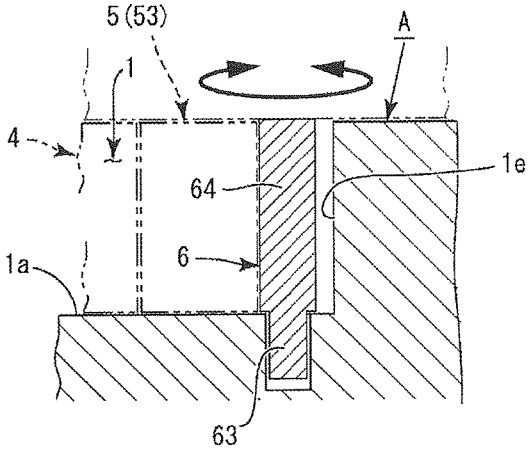
FIG. 9D is an enlarged front view of a relevant part of the present invention in which a third-type pin according to the second embodiment is used.

The pins 6 of a third type are turnably installed in the rotor chamber 1 (see FIG. 9D). Specifically, one ends of the pins 6 in a longitudinal direction are turnably inserted into the fitting holes 1*c* formed on the bottom surface 1*a* of the rotor chamber 1. With this configuration, when the cam sliding surfaces 53*a* of the cam protruded parts 53 slide to the pins 6 based on the oscillation of the outer ring 5, the pins 6 support the cam protruded parts 53 while rotating.

Further, in this type, when each pin 6 has a small-diameter shaft part 63 as an insertion part to be inserted into the fitting hole 1*c* of the rotor chamber 1 and also when a portion protruded from the bottom surface 1*a* is a large-diameter shaft part 64 having a stepped shaft shape, the pin 6 can be installed in the rotor chamber 1 in an extremely stable state. In this case, a portion of the pin 6 that is brought into contact with the cam protruded part 53 of the outer ring 5 is the large-diameter shaft part 64.

According to the second aspect of the present invention, in the first aspect, in contacting and sliding between the pins and the cam protruded parts, the pins are brought into point contact with the cam protruded parts at the same portions. With this configuration, precision is required at only one position where the contact is performed. As a result, manufacturing and inspection time can be minimized.

According to the third aspect of the present invention, the pins have arc shapes at portions that are brought into contact with the cam protruded parts. Therefore, even when there is a slight change in an angle at which each pin and each cam protruded part are brought into contact with each other, the contact becomes always a point contact as an arc-shaped surface. The contact is performed always in a constant manner, and stable control can be performed.

According to the fourth aspect of the present invention, because the pins have circular cylindrical shapes, a configuration of each fitting hole into which each pin is installed can be in a simplest round (circular) shape, and the pins can be provided at low cost. According to the fifth aspect of the present invention, the pins are made of iron alloys. Therefore, even when the pump housing is manufactured by casted aluminum, a portion of particularly rapid abrasion can be made of a solid and durable material, by using iron alloys for only the pins.

According to the sixth aspect of the present invention, a space is configured to be provided between the pins and the inner periphery side surface of the rotor chamber. Therefore, even when contaminants (abnormalities) and the like in the oil are adhered to the sliding parts of the pins, based on the space, the contaminants (abnormalities) do not stay, and flow to a space part between the inner periphery side surface of the pump housing and the pins. As a result, the contaminants (abnormalities) can be suppressed from staying in the sliding parts of the pins.

According to the seventh aspect of the present invention, in the rotor chamber, stopper wall surface parts with which the cam protruded parts are brought into contact are formed to regulate an oscillation angle of the outer ring to within a predetermined range. Accordingly, the outer ring can be securely operated within a predetermined oscillation range.

According to the eighth aspect of the present invention, in contacting and sliding between the pins and the cam protruded parts, the pins are brought into point contact with the cam protruded parts while turning. Therefore, following a change of an angle of a cam sliding surface of each cam protruded part of the outer ring, each pin itself turns. Accordingly, because the pin does not slide at the same position when the pin is brought into contact with the cam protruded part, abrasion resistance improves, and durability of the pump also improves.

According to the ninth aspect of the present invention, the pins are turnably installed in the rotor chamber. The pins become turnable in a simplest configuration in this way. According to the tenth aspect of the present invention, the pins are configured by supporting pillar parts and collar parts, and the collar parts are in cylindrical shapes and are turnably installed on the supporting pillar parts. Therefore, a turn operation of the collar part becomes smooth, and slidability of the pins with the cam protruded parts of the outer ring becomes satisfactory. Abrasion resistance can be further improved.

According to the eleventh aspect of the present invention, the pins are configured by supporting pillar parts and collar parts, and the collar parts are ball bearings. Therefore, turning of the collar part becomes extremely smooth. Further, in addition to abrasion resistance, noise generated at a sliding time can be made small.

EXPLANATION OF REFERENCE NUMERALS

A PUMP HOUSING
1 ROTOR CHAMBER
1*s* SPACE
1*d* STOPPER WALL SURFACE PART
3 INNER ROTOR
4 OUTER ROTOR
5 OUTER RING
51 HOLDING-INNER PERIPHERAL PART
52 OUTER PERIPHERY SURFACE
53 CAM PROTRUDED PART
6 PIN
61 SUPPORTING PILLAR PART
62 COLLAR PART
7 OPERATION MEANS
P3 ROTATION CENTER (OF INNER ROTOR)
P4 ROTATION CENTER (OF OUTER ROTOR)
P5 DIAMETER CENTER (OF OUTER RING)
Q LOCUS OF CIRCLE
e ECCENTRICITY

What is claimed is:

1. An internal gear pump comprising:
an inner rotor;
an outer rotor that rotates with predetermined eccentricity to a rotation center of the inner rotor;
an outer ring that includes a holding-inner peripheral part rotatably holding the outer rotor and that has at least three cam protruded parts formed along a circumferential direction of an outer periphery surface of the outer ring;
a pump housing that has a rotor chamber in which the outer ring is freely and oscillatably arranged;
pins disposed in the rotor chamber separate from the pump housing that are in the same number as that of the cam protruded parts and that respectively engagingly contact the cam protruded parts; and
operation means for oscillating the outer ring,
wherein the cam protruded parts comprise cam sliding surfaces,
wherein at least one of the cam sliding surfaces of one of the cam protruded parts includes an inclined surface that is increasingly separated from the outer periphery surface of the outer ring from one end of the inclined surface to the other end of the inclined surface along the circumferential direction, and
wherein positions of the disposed pins are further set in the rotor chamber in relation to the outer ring so that a diameter center of the holding-inner peripheral part of the outer ring is moved by the operation means along a locus of a circle, the radius of which is the predetermined eccentricity to the rotation center of the inner rotor.

2. The internal gear pump according to claim 1, wherein the contact between each pin and the corresponding cam protruded part is along only a portion of each pin.

3. The internal gear pump according to claim 2, wherein each of the pins comprises an arc shape at a portion of each pin that is brought into the contact with the corresponding cam protruded part.

4. The internal gear pump according to claim 2, wherein each the pins comprises a circular cylindrical shape.

5. The internal gear pump according to claim 2, wherein a space is respectively provided between each of the pins and an inner periphery side surface of the pump housing adjacent to the rotor chamber.

6. The internal gear pump according to claim 2, wherein a stopper wall surface part, with which each cam protruded part is brought into contact, regulates an oscillation angle of the outer ring to within a predetermined range.

7. The internal gear pump according to claim 1, wherein each of the pins comprises an arc shape at a portion of each pin that is brought into the contact with the corresponding cam protruded part.

8. The internal gear pump according to claim 7, wherein each the pins comprises a circular cylindrical shape.

9. The internal gear pump according to claim 7, wherein a space is respectively provided between each of the pins and an inner periphery side surface of the pump housing adjacent to the rotor chamber.

10. The internal gear pump according to claim 7, wherein a stopper wall surface part, with which each cam protruded part is brought into contact, regulates an oscillation angle of the outer ring to within a predetermined range.

11. The internal gear pump according to claim 1, wherein each the pins comprises a circular cylindrical shape.

12. The internal gear pump according to claim 1, wherein a space is respectively provided between each of the pins and an inner periphery side surface of the pump housing adjacent to the rotor chamber.

13. The internal gear pump according to claim 1, wherein a stopper wall surface part, with which each cam protruded part is brought into contact, regulates an oscillation angle of the outer ring to within a predetermined range.

14. The internal gear pump according to claim 1, wherein, during operation of the internal gear pump, the contact between the pins and the corresponding cam protruded parts further includes each pin contactingly moving along a surface of the corresponding cam protruded part while turning in rotation.

15. The internal gear pump according to claim 14, wherein each of the pins includes a supporting pillar part and collar part and the collar part comprises a cylindrical shape and is disposed on the supporting pillar part.

16. The internal gear pump according to claim 14, wherein each pin includes a supporting pillar part and a collar part and the collar part is configured as a ball bearing.

17. An internal gear pump comprising:

an inner rotor;

an outer rotor that rotates with predetermined eccentricity to a rotation center of the inner rotor;

an outer ring that includes a holding-inner peripheral part rotatably holding the outer rotor and that has at least three cam protruded parts formed along a circumferential direction of an outer periphery surface of the outer ring;

a pump housing that has a rotor chamber in which the outer ring is freely and oscillatably arranged;

a plurality of pins disposed in the rotor chamber separate from the pump housing that are in the same number as that of the cam protruded parts and respectively engagingly contact the cam protruded parts and that are disposed in the rotor chamber separate from the pump housing; and operation means for oscillating the outer ring, wherein the cam protruded parts are formed at predetermined intervals along a circumferential direction of the outer periphery surface of the outer ring and each disposed pin of the plurality of pins is positioned radially outbound from a respective cam protruded part; and wherein positions of the disposed plurality of pins are further set in the rotor chamber so that a diameter center of the holding-inner peripheral part of the outer ring is moved by the operation means along a locus of a circle, the radius of which is the eccentricity to the rotation center of the inner rotor.

18. The internal gear pump according to claim 17, wherein the contact between each pin of the plurality of pins and the corresponding cam protruded part is along only a portion of each pin.

19. The internal gear pump according to claim 18, wherein each of the plurality of pins comprises an arc shape at a portion of each pin that is brought into the contact with the corresponding cam protruded part.

20. The internal gear pump according to claim 18, wherein each the plurality of pins comprises a circular cylindrical shape.

21. The internal gear pump according to claim 18, wherein a stopper wall surface part, with which each cam protruded part is brought into contact, regulates an oscillation angle of the outer ring to within a predetermined range.

22. The internal gear pump according to claim 17, wherein each of the plurality of pins comprises an arc shape at a portion of each pin that is brought into the contact with the corresponding cam protruded part.

23. The internal gear pump according to claim 22, wherein each the plurality of pins comprises a circular cylindrical shape.

24. The internal gear pump according to claim 22, wherein a space is respectively provided between each of the plurality of pins and an inner periphery side surface of the pump housing adjacent to the rotor chamber.

25. The internal gear pump according to claim 22, wherein a stopper wall surface part, with which each cam protruded part is brought into contact, regulates an oscillation angle of the outer ring to within a predetermined range.

26. The internal gear pump according to claim 17, wherein each the plurality of pins comprises a circular cylindrical shape.

27. The internal gear pump according to claim 26, wherein a space is respectively provided between each of the plurality of pins and an inner periphery side surface of the pump housing adjacent to the rotor chamber.

28. The internal gear pump according to claim 17, wherein a space is respectively provided between each of the plurality of pins and an inner periphery side surface of the pump housing adjacent to the rotor chamber.

29. The internal gear pump according to claim 17, wherein a stopper wall surface part, with which each cam protruded part is brought into contact, regulates an oscillation angle of the outer ring to within a predetermined range.

30. The internal gear pump according to claim 17, wherein, during operation of the internal near pump, the contact between the pins and the corresponding cam protruded parts further includes each pin contactingly moving along a surface of the corresponding cam protruded part while turning in rotation.

31. The internal gear pump according to claim 30, wherein each of the plurality of pins includes a supporting pillar part and collar part and the collar part comprises a cylindrical shape and is disposed on the supporting pillar part.

32. The internal gear pump according to claim 30, wherein each pin of the plurality of pins includes a supporting pillar part and a collar part and the collar part is configured as a ball bearing.

* * * * *